United States Patent [19]

Carson

[11] 4,040,461

[45] Aug. 9, 1977

[54] NESTABLE FRUIT HARVESTING CONTAINER

[76] Inventor: William S. Carson, 218 Escambia Drive, Winter Haven, Fla. 33880

[21] Appl. No.: 712,946

[22] Filed: Aug. 9, 1976

[51] Int. Cl.[2] ..... B65D 33/14

[52] U.S. Cl. ..... 150/51; 150/1; 206/515; 220/63 R

[58] Field of Search ..... 206/515, 519, 520; 150/48, 49, 50, 51, 2, 1; 220/63 R

[56] References Cited

U.S. PATENT DOCUMENTS

| | | | |
|---|---|---|---|
| 711,410 | 10/1902 | Means | 150/51 |
| 944,807 | 12/1909 | Mitchell | 150/51 |
| 1,087,702 | 2/1914 | Van Patten | 150/48 |
| 1,148,949 | 8/1915 | Benjamin | 150/51 |
| 1,492,453 | 4/1924 | Haines | 150/51 |
| 1,642,643 | 9/1927 | Carruth | 150/51 |
| 2,493,181 | 1/1950 | Andersen | 150/51 |
| 2,785,725 | 3/1957 | Gold | 150/51 |

*Primary Examiner*—George E. Lowrance

[57] ABSTRACT

A nestable fruit harvesting container is formed from a metal basket-like frame and a flexible bag which is supported within the frame. The frame is generally frusto-conical in shape and includes vertically spaced top and bottom rings and a plurality of side braces which extend between the top and bottom rings. The bottom ring is smaller than the top ring, and the side braces diverge outwardly and upwardly from the bottom ring to the top ring. The bag includes a generally frusto-conical side portion which is confined within the side braces and a bottom portion which closes the bottom of the bag. The upper edge of the bag is secured to the top ring, and a reinforcing strip is secured to the inside of the bag opposite each of the side braces.

10 Claims, 7 Drawing Figures

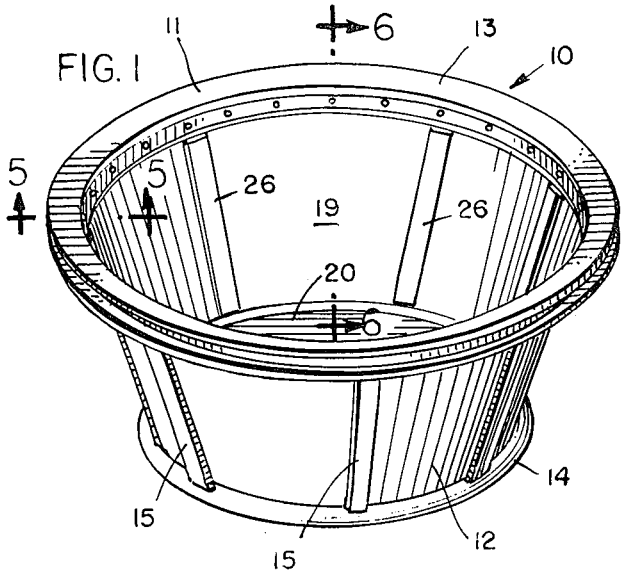
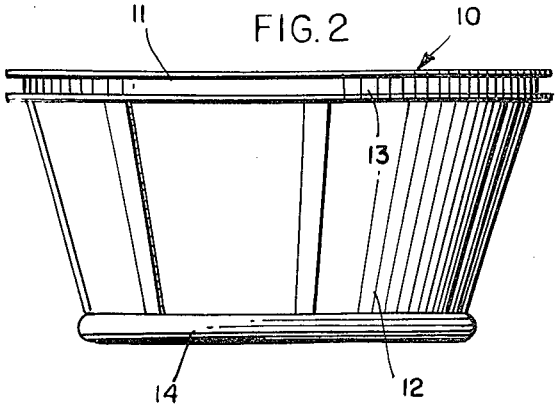
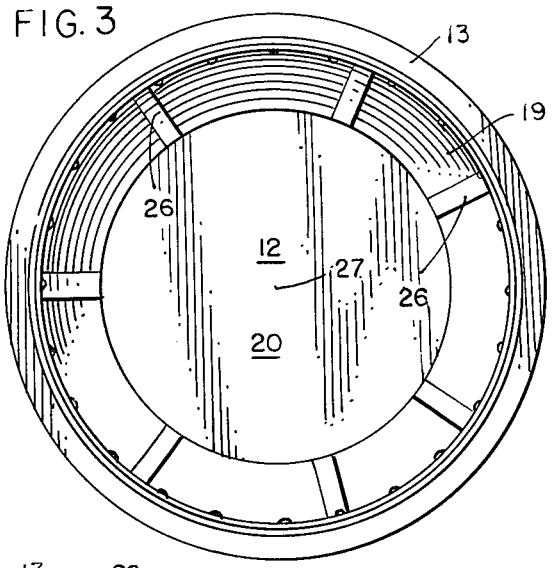
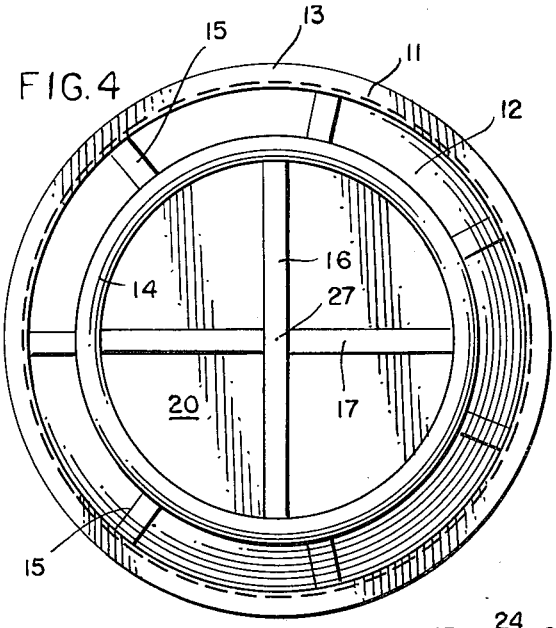
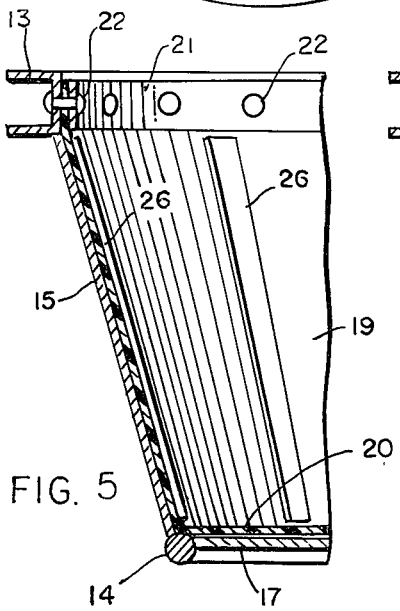
FIG. 5
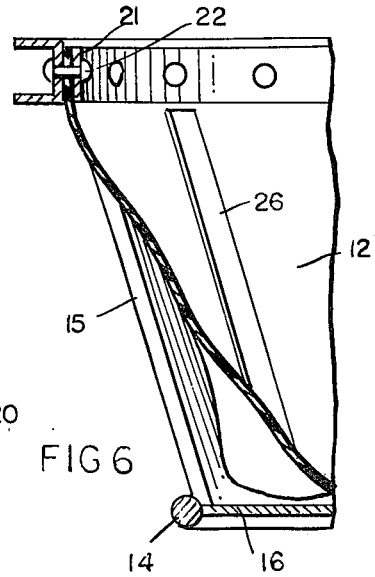
FIG 6
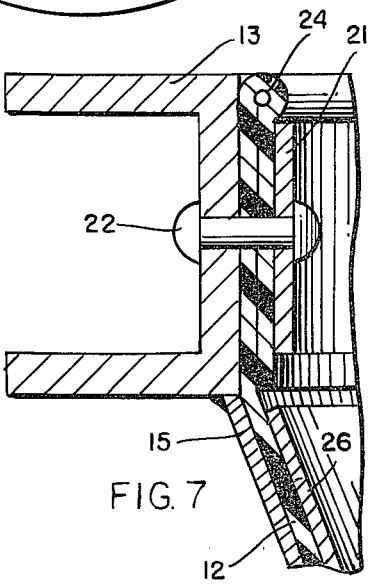
FIG. 7

NESTABLE FRUIT HARVESTING CONTAINER

BACKGROUND AND SUMMARY

This invention relates to fruit harvesting containers, and, more particularly, to fruit harvesting containers which are intended to be lifted and emptied by hydraulic lifting devices.

Fruit such as oranges, grapefruit, and the like are often harvested by pickers who pick the fruit from the trees and dump the fruit into large containers. Filled containers are lifted above a substantially larger truck-mounted container by hydraulically operated lift devices, and the lift devices are generally capable of tilting the container to dump the fruit into the larger container. Some lifting devices and containers for use therewith which have been used by the citrus industry are described in U.S. Pat. Nos. 2,981,424; 3,119,505; 3,618,800; and 3,712,504.

With the exception of the container described in U.S. Pat. No. 3,712,504, containers which have been generally used in the citrus industry are relatively rigid. Since harvesting containers frequently encounter severe impacts as the container is swung about by the lift device or dropped to the ground, a relatively rigid container can easily be broken and rendered useless during normal use. Further, many containers are relatively heavy, which increases the possibility of damage when the containers are dropped.

It is desirable that fruit harvesting containers be constructed in a manner which permits the container to withstand the impacts which the container will receive during normal use, and it is also desirable that the container be nestable so that a plurality of containers can be stored when not in use in a minimum amount of space. Plastic tub-like containers are available, but, although these containers are nestable and lighweight and can withstand impacts to a certain extent, certain problems remain. For example, the plastic tubs can be crushed as they are engaged and lifted by the lifting device, and the plastic tubs can still be broken by impacts, particularly in cold weather.

The invention provides a fruit harvesting container which is extremely light in weight, is nestable, and can readily withstand impacts. The fruit is held by a flexible bag which is supported within a metal skeleton frame. The frame supports the bag against the internal pressure created by the weight of the fruit, but substantially the entire outer surface of the container is provided by the flexible bag. As a result, impacts which are directed against the container generally engage the flexible bag rather than the frame, and the flexible bag can readily deform inwardly to absorb the force of the blow. As soon as the object which creates the blow is removed, the flexible bag can return to its original shape. The frusto-conical shape of the container permits a plurality of containers to be nested within each other, and reinforcing strips secured to the inside of the bag protects the bag from being chafed between the frames of two adjacent nested containers. The reinforcing strips also help the bag to hold the desired frusto-conical shape and prevent the bag from being turned inside out if the container is inverted.

DESCRIPTION OF THE DRAWING

The invention will be explained in conjunction with an illustrative embodiment shown in the accompanying drawing, in which FIG. 1 is a perspective view of a container formed in accordance with the invention;

FIG. 2 is an elevational view of the container;

FIG. 3 is a top plan view of the container;

FIG. 4 is a bottom plan view of the container;

FIG. 5 is a fragmentary sectional view taken along the line 5—5 of FIG. 1;

FIG. 6 is a fragmentary sectional view taken along the line 6—6 of FIG. 1 showing the bag being deformed by an inwardly directed blow; and FIG. 7 is an enlarged fragmentary view of a portion of FIG. 5.

DESCRIPTION OF SPECIFIC EMBODIMENT

The numeral 10 designates generally a fruit harvesting container which comprises an outer frame 11 and a flexible bag 12 which is supported within the frame. The container is specifically designed for use with the lifting device described in my co-pending United States patent application entitled "Container-Dumping Apparatus", Ser. No. 707,376 filed July 21, 1976, but the container can be used with other types of lifting devices.

The frame 11 includes a top ring 13, a bottom ring 14, and a plurality of side braces 15 which extend between and are secured to the top and bottom rings. The bottom ring 14 has a smaller diameter than the top ring 13, and the side braces diverge upwardly and outwardly from the bottom ring to the top ring at circumferentially spaced locations around the rings to provide the container with a frusto-conical shape. A pair of bottom braces 16 and 17 (FIG. 4) extend across the bottom ring and are secured thereto.

In the particular embodiment illustrated, the top ring 13 is generally channel-shaped in cross section, and the bottom ring 14 is circular in transverse cross section. The side braces15 and the bottom braces 16 and 17 are formed from flat strips. The frame is advantageously formed of metal, and the various parts thereof can be secured by welding.

The bag 12 includes a side portion 19 which is shaped to conform generally to the frusto-conical shape of the inside of the frame and a bottom portion 20 which extends across the bottom ring 14. As can be seen in FIG. 5, the upper edge of the bag extends upwardly along the inside of the channel-shaped ring 13, and the upper edge of the bag is squeezed against and secured to the ring by a retaining ring 21 which is secured to the top ring 13 by rivets 22. The rivets extend through the retaining ring, the bag, and the top ring at circumferentially spaced locations around the container, and the spacing between adjacent rivets is desirably no more than about 12 inches.

In order to strengthen the connection of the upper edge of the bag to the frame and to prevent tearing of the bag in the areas of the openings through which the rivets extend, I have found it desirable to incorporate a retaining member in the upper edge of the bag. The upper edge of the bag is folded over a circular retaining member 24 (FIG. 7), which can be a rope, wire, or the like, and the downwardly extending folded edge portion can be suitably secured to the side of the bag to enclose the retaining member. I have had good results by using a bag formed from plastic-coated fabric, and the folded upper edge portion of such a bag can be secured by heat-sealing the folded portion to the side of the bag. The plastic coating can be vinyl or neoprene, and the coated fabric can be nylon or other suitable material. Alternatively, the bag can be formed of canvas or other flexible material, and the folded upper edge portion of the bag can be secured by stitching.

A plurality of reinforcing strips 26 are secured to the inside of the bag. Each reinforcing strip is aligned with one of the metal braces which support the outside of the bag, and the reinforcing strip is substantially coextensive with the brace as shown in FIG. 4. The reinforcing strips are advantageously formed of flexible material, such as plastic, and the reinforcing strips are suitably secured to the bag, as by rivets. If the bag is formed from a plastic-coated material, the reinforcing strips can be heat sealed to the bag.

One of the important functions of the reinforcing strips is to protect the bag when a plurality of containers are nested. When the containers are nested, the outer metal braces 15 of a container fits within the bag of the next lowermost container. If the metal braces 15 of two adjacent containers happen to be aligned, the bag which is positioned between the sets of aligned braces can be rubbed or chafed to the extent that the bag becomes worn through or otherwise damaged. However, with my container the reinforcing strips 26 will be interposed between the two sets of braces and will prevent the braces of a container from rubbing against the bag of the lower container.

If two containers are nested in positions in which the braces of the containers are not aligned, there is little danger that the bag of a container will be damaged by the braces of the upper container because the flexible bag is free to move outwardly between the braces of its container when it is engaged by the braces of an upper container.

The reinforcing strips also help the bag to maintain its shape and to restrain the bag from turning inside out when the container is inverted or when the container is transported by being rolled along either the upper ring or the lower ring. The bag can also be prevented from turning inside out by securing the center of the bottom of the bag to the bottom braces 16 and 17 at the intersections thereof, as by a rivet 27 (FIG. 3).

If an object is forced against the side or bottom of the container and engages the bag, the flexible plastic bag can deform inwardly to absorb the force, and the container will not be damaged. The deformability of the bag is illustrated in FIG. 5, in which a force directed against the container is indicated by the arrow. If an object engages the side braces 15 with sufficient force to deform a side brace or to detach a brace from either the top or bottom ring, the container can be easily and quickly repaired merely by removing the broken or deformed brace and replacing it with a new brace. Such repair can be accomplished by simple cutting and welding operations.

The container is intended to be used with a lifting device such as that described in my previously identified patent application. The lift device described in that application lifts the container by hooks which are inserted into the channel-shaped top ring 13, and the lift device can empty the container by tilting the container through an angle of about 90°. The reinforcing strips and the attachment of the bag to the bottom braces 16 and 17 prevent the bag from turning inside out while the container is being emptied, and the bag is ready for refilling as soon as it is returned to the ground by the lifting device. At the end of the harvesting day, the containers can be nested for transportation or storage by the lifting device.

Since the metal frame of the container is a skeleton-type frame and since the containing function of the container is provided by the bag, the container is extremely lightweight. This not only reduces the strain on the lifting device but permits the container to be easily manipulated by a worker. The light weight of the container also substantially reduces the possibility that the container will be damaged if it is dropped.

While in the foregoing specification a detailed description of a specific embodiment of the invention has been set forth for the purpose of illustration, it will be understood that many of the details hereingiven may be varied considerably by those skilled in the art without departing from the spirit and scope of the invention.

I claim:

1. A nestable fruit harvesting container comprising a generally frusto-conical frame and a flexible bag supported within the frame, the frame comprising a top ring and a bottom ring and a plurality of brace strips which extend between the top and bottom rings and which are secured thereto at circumferentially spaced locations therearound, the diameter of the bottom ring being less than the diameter of the top ring and the brace strips extending outwardly and upwardly from the bottom ring toward the top ring, the outside of the bag engaging and being supported by the brace strips, and a reinforcing strip secured to the inside of the bag opposite each of the brace strips, whereby a plurality of containers can be nested within each other and the reinforcing strips of a container protect the bag of the container from chafing between the brace strips of the container and the brace strips of the next higher container.

2. The container of claim 1 in which the reinforcing strips are generally coextensive with the brace strips.

3. The container of claim 1 in which the bag includes a generally frusto-conical side portion and a bottom portion, the side portion terminating in an upper edge portion which is secured to the top ring of the frame, the side portion of the bag being otherwise unsecured to the frame whereby the side portion of the bag can move inwardly under the impact of a blow.

4. The container of claim 3 in which the frame includes a base member which extends across the bottom ring, the bottom of the bag being secured to the base member.

5. The container of claim 1 in which the reinforcing strips are formed of flexible plastic.

6. The container of claim 1 including a retaining ring aligned with the top ring inside the bag, and means securing the retaining ring and the bag to the top ring.

7. The container of claim 6 in which the upper edge of the bag is folded downwardly over a retaining member which extends around the bag above the retaining ring, the retaining member and the upper edge of the bag being secured against downward movement by the retaining ring.

8. The container of claim 7 in which the bag includes a plastic coating and the downwardly folded portion of the bag is heat sealed to the bag to enclose the retaining member.

9. The container of claim 1 in which the top ring is generally channel-shaped in transverse cross section.

10. The container of claim 1 in which the bottom ring is generally circular in transverse cross section.

* * * * *